US005289609A

United States Patent [19]

Olson

[11] Patent Number: 5,289,609

[45] Date of Patent: Mar. 1, 1994

[54] GUIDE FOR CLEANING PAINT FROM WINDOWS

[76] Inventor: Rudolph C. Olson, Rte. 1, Box 1874, Fort Gibson, Okla. 74434

[21] Appl. No.: 844,535

[22] Filed: Mar. 2, 1992

[51] Int. Cl.[5] ..... E04F 21/00

[52] U.S. Cl. ..... 15/257.01; 118/504

[58] Field of Search ..... 15/257.01; 118/504

[56] References Cited

U.S. PATENT DOCUMENTS

| | | | |
|---|---|---|---|
| 1,292,071 | 1/1919 | Roe . | |
| 1,386,706 | 8/1921 | Hall . | |
| 1,411,462 | 4/1922 | Wendt . | |
| 1,729,279 | 9/1929 | Shinn, Jr. . | |
| 2,289,136 | 7/1942 | Matter | 91/65 |
| 2,698,002 | 12/1954 | Thoss | 118/504 |
| 2,726,633 | 12/1955 | Miron | 118/504 |
| 2,787,056 | 4/1957 | Dobratz | 30/170 |
| 2,893,042 | 7/1959 | Paskaly | 15/257 |
| 3,178,747 | 4/1965 | Peterson | 15/236 |
| 3,565,038 | 2/1971 | Van Barriger | 118/504 |
| 4,241,693 | 12/1980 | Shotwell | 118/504 |
| 4,383,496 | 5/1983 | Shotwell | 118/504 |
| 4,536,913 | 8/1985 | Morawski | 15/257 |
| 4,709,478 | 12/1987 | Cortelyou, Jr. | 30/169 |
| 5,058,274 | 10/1991 | Smith | 30/169 |

FOREIGN PATENT DOCUMENTS

| | | | |
|---|---|---|---|
| 695572 | 8/1953 | United Kingdom | 118/504 |

*Primary Examiner*—Chris K. Moore

*Attorney, Agent, or Firm*—Head & Johnson

[57] ABSTRACT

A guide for cleaning paint from a window to be used with a razor blade scraper or the like. The guide includes a first panel having a pair of opposed edges, one of the edges having a straight, elongated blade that may be placed against the window flush with a sash or glazed side of the window. A second panel extends from the opposed edge of the first panel, the second panel being in angular relation to the first panel. A third panel extends from the second panel, the third panel being substantially parallel with the first panel. A fourth panel extends from the third panel wherein the fourth panel may be held in one hand of the user while the other hand moves the scraper along the elongated blade to remove paint on the window except for a thin band covered by the blade.

5 Claims, 2 Drawing Sheets

GUIDE FOR CLEANING PAINT FROM WINDOWS

BACKGROUND OF THE INVENTION

1. Field of the Invention

The present invention pertains to a guide or tool to assist in cleaning or scraping paint from a window with a scraper or the like.

2. Prior Art

In painting window sashes, at least some paint will ordinarily be left on the window panes. Since it is unsightly to leave paint on the window pane, a razor blade or other known scraper is often used to remove the paint from the window pane after the painting has been completed. It is desirable for aesthetic reasons to leave a straight line when the paint has been removed. The use of a razor blade or other scraper may, however, result in gouging the window sash or glazing.

Moreover, it is desirable to leave a very thin line of paint on the window pane where the window sash meets the glass. If the sash or glazing therewith is scraped or cut, the seal which the paint provides against moisture is broken. Water or moisture may gather and work its way underneath the paint. The value of the paint is thereby diminished.

In the past, a number of devices have been utilized to scrape the paint from the window pane. Razor blade holders which retain a razor blade and have a handle such as Brown (U.S. Pat. No. 2,164,050) and Shinn, Jr. (U.S. Pat. No. 1,729,279) are typical. These holders and accompanying razor blades work well to scrape paint from the window. They do not, address the problem of aesthetically leaving a straight line or the problem of retaining the seal that the paint provides with the window.

Other devices have been utilized to trim paint from a window pane.

Paskaly (U.S. Pat. No. 2,893,042) provides a hand-held guide to trim paint from window panes after painting while leaving a narrow band of paint as a seal. The guide would be used in combination with a razor blade or other scraper. The guide is constructed of a multitude of pieces that are held together by fasteners. Additionally, the guide must mate with the window sash to operate.

Dobratz (U.S. Pat. No. 2,787,056) discloses a scraper device which is mounted on rollers wherein a blade spaced a short distance from the sash moves along the glass to trim paint.

Cortelyou, Jr. (U.S. Pat. No. 4,709,478) discloses a paint scraper with a body extending wider than the blade to leave a narrow border.

Various guards are likewise known which may be used during the painting process to prevent the paint from being applied in an undesirable area.

Morawski (U.S. Pat. No. 4,536,913), Hall (U.S. Pat. No. 1,386,706), Shotwell (U.S. Pat. No. 4,241,693 and U.S. Pat. No. 4,383,496), Miron (U.S. Pat. No. 2,726,633), Wendt (U.S. Pat. No. 1,411,462), Matter (U.S. Pat. No. 2,289,136) and Roe (U.S. Pat. No. 1,292,071) each disclose paint guards used during the painting process.

At the same time, it is known that when the paint is fresh it may be easily scraped off. After a period of time, the paint ages and loses its elasticity. Thereafter, scraping of the paint from the window pane tends to chip or shatter the paint. Again, not only is a straight line difficult to achieve but the seal provided by the paint is broken.

Accordingly, it is a principal object and purpose of the present invention to provide a guide for use with a scraper or the like in order to clean or scrape the paint from a window.

It is a further object and purpose of the present invention to provide a guide for cleaning paint from windows which will allow retention of and leave a thin border or line of paint on the window where the window sash meets the glass.

It is an additional object and purpose of the present invention to provide a guide for cleaning paint from windows wherein force may be applied to the border or line of paint to prevent the paint from chipping or cracking.

SUMMARY OF THE INVENTION

The present invention provides a guide to be used as a handheld tool for assisting in cleaning paint from windows. It will be used in conjunction with a razor blade scraper or other scraping device.

The guide includes a first panel which is substantially flat and elongated. The first panel has a pair of opposed edges, one edge having a straight elongated blade. The thickness of the blade is such that when the tool is held in place against a window pane for use, a thin line or band of paint will be covered up or concealed by the thickness of the elongated blade.

Extending from the edge of the first panel opposed to the elongated blade is a second panel, which is in angular relation with the first panel.

A third panel extends outward from the second panel and is in angular relation with the second panel. The third panel is substantially parallel with the first panel.

Extending from the third panel is a flat, fourth panel which is used as a handle to be held in the hand of the user.

DETAILED DESCRIPTION OF THE PREFERRED EMBODIMENT

Figure 1:
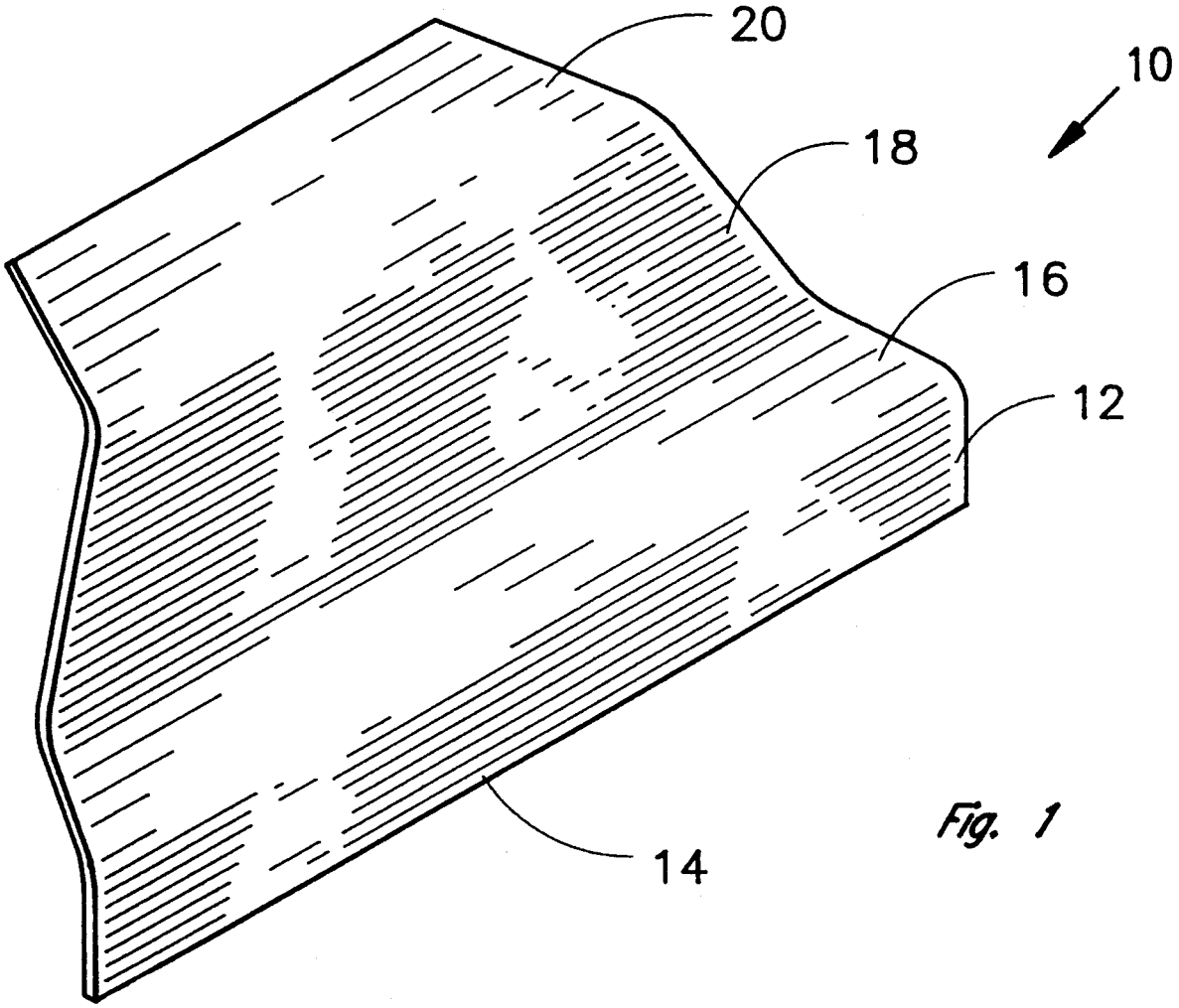
FIG. 1 illustrates a perspective view of a guide to be used in cleaning paint from a window.

Referring to the drawings in detail, FIG. 1 illustrates a perspective view of a guide 10 for assisting in cleaning paint from windows. As will be described, the guide is used as a hand-held tool to be used in conjunction with a razor blade scraper or other scraping device.

After paint has been applied to a window sash with a brush, roller, or other device, inevitably some paint is left on the windows. It is aesthetically desirable to have a straight edge of paint rather than paint on the windows with a jagged edge. Additionally, it is desirable to leave a thin line or band of paint on the window where the window pane meets the sash or glazing. This is desirable so that the water and moisture seal created by the paint will extend to the window pane.

The guide itself may be fabricated from a variety of materials, although it has been found that the use of a metal which will not be gouged with a razor blade scraper is preferable. A hard grade of metal such as hard stainless has been found to be acceptable.

The guide 10 includes a first panel 12 which is substantially flat and elongated. The first panel 12 has a pair of opposed edges, one edge having a straight elongated blade 14. The elongated blade may be placed against the window pane. In use, the tool will be held in one hand with the entire length of the blade 14 against the window pane flush with the window sash.

The thickness of the elongated blade 14 is such that when held in place for use, a thin line or band of paint will be covered up or concealed by the thickness of the elongated blade 14. In the present embodiment, the blade is 5/100 of an inch thick although other thicknesses may be used.

Extending from the edge of the first panel opposed to the elongated blade is a second panel 16. The second panel 16 is in angular relation with the first panel 12. In the present embodiment, the second panel is approximately 55° from alignment with the first panel.

A flat third panel 18 extends from the second panel 16. The third panel is in angular relation to the second panel. In the present embodiment, the third panel is substantially parallel with the first panel. Accordingly, the arrangement of the second panel 16 with the first and third panels provides an offset or step. This is advantageous for a number of reasons. With the step or offset, the guide 10 may be held in a position away from the elongated blade as will be seen.

Extending from the third panel 18 is a fourth panel 20 which is generally flat. The fourth panel 20 may be held in the hand of a user (not shown).

The entire guide 10 may be fabricated from a single piece of metal material, such as hard stainless. By starting with a single piece of flat metal and bending to the appropriate dimensions, the guide 10 may be simply and economically made. In the present embodiment, the guide is longest at the elongated blade and tapers from there.

Figure 2:
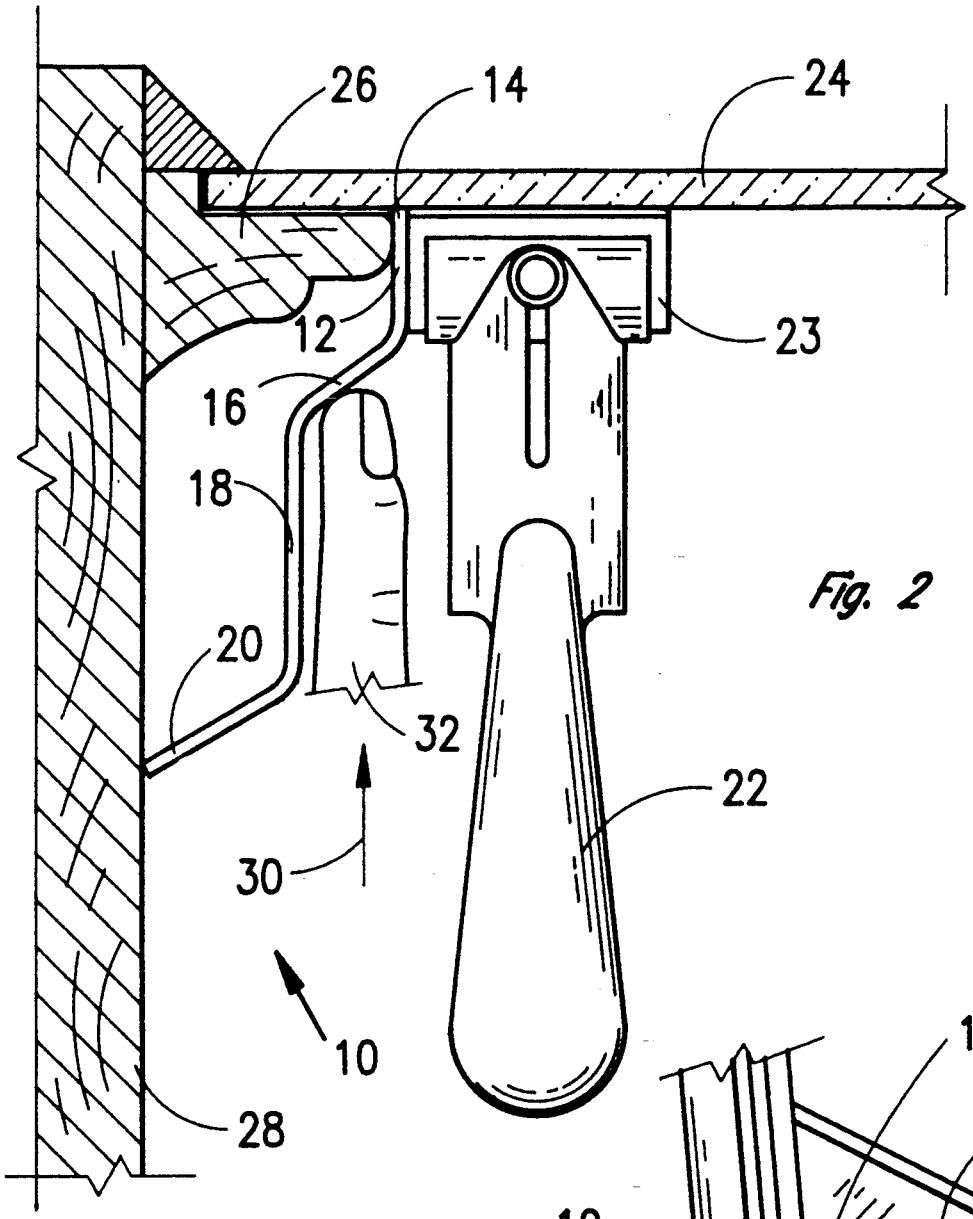
FIG. 2 illustrates a side view of the guide as shown in FIG. 1 in use on a window pane wherein a razor blade scraper is used to remove excess paint.

FIG. 2 shows the guide 10 in use with a razor blade scraper 22 holding a razor blade 23. The guide is shown in use on the inside of the window, although it may also be used on the outside.

A window pane 24 and window sash 26 are seen in sectional view. The window sash 26 abuts a vertical wall 28 also shown in sectional view.

It will be understood that the present invention may not only be used with wooden sashes, as illustrated, but may be used with metal or other sashes.

When the guide 10 is used where no vertical wall or other obstruction is involved, the guide may be easily held in the user's hand by holding the fourth panel 20.

In situations with a vertical wall or a vertical window frame such as illustrated in FIG. 2, however, it is more difficult to hold the guide 10 in proper position.

In those cases, the second panel 16 may be used as a bearing plate so that pressure may be applied against the second panel 16 which, in turn, urges the elongated blade 14 against the window pane 24. The direction of force applied by the user is illustrated by the arrow 30. Even if the fourth panel 20 may not be grasped, a finger or fingers 32 may be pressed against the bearing plate.

If it is desirable to increase the width of the band of paint that remains on the window pane, it is simple to affix layers of tape (not shown) to the side of the elongated blade 14. The width of the elongated blade may thus be adjusted.

In situations where the paint has been allowed to age for some time before the windows are scraped, it has been found that the paint ages and loses its elasticity. Scraping of the paint from the window pane thereafter tends to chip or shatter the paint. Use of the guide 10 in those situations is advantageous for an additional reason. The blade will press the paint firmly against the window pane and any shattering or chipping will be avoided on the thin line of paint.

As an optional step, the corner of the razor blade 22 or scraper may be first used to scribe the paint along the elongated blade 14 of the guide 10 before placing the razor blade flat against the window pane 24.

After use of the guide 10 and the razor blade scraper 22, a clean and precise trim line of paint results.

Figure 3:
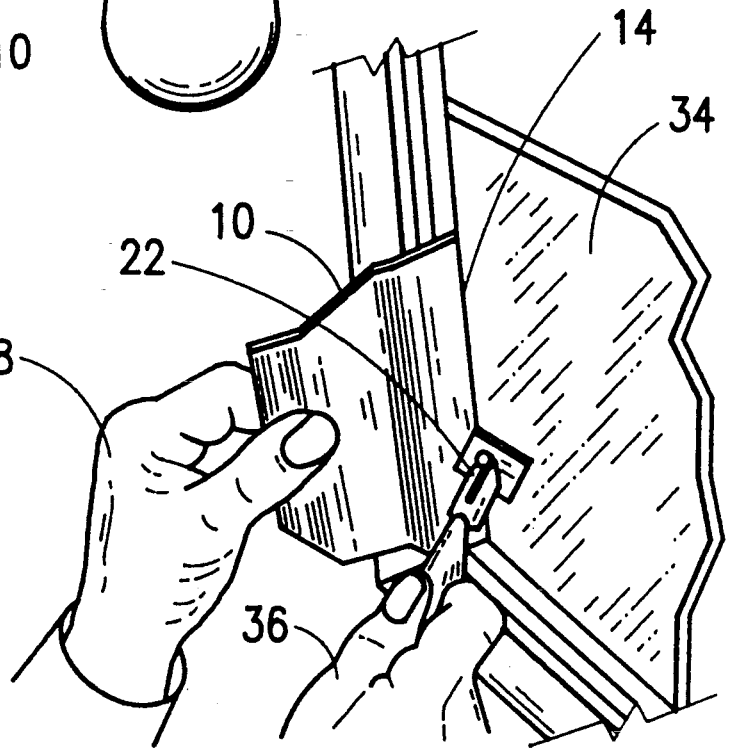
FIG. 3 illustrates the guide as shown in FIG. 1 in use on another window pane.

FIG. 3 illustrates the conventional use of the guide 10 on a window pane 34.

A razor blade scraper 22 is moved across the window pane 34 along the elongated blade 14. This is done with one hand 36 while the other hand 38 holds the fourth panel 20 of the guide. Once the razor blade scraper 22 is moved along the entire length of the elongated blade, the guide will be lifted from the placement on the window pane and moved so that another section of the window pane may be cleaned.

It has been found that even a window with many panes may be quickly and effectively cleaned.

Whereas, the present invention has been described in relation to the drawings attached hereto, it should be understood that other and further modifications, apart from those shown or suggested herein, may be made within the spirit and scope of this invention.

What is claimed is:

1. A guide for removing excess dry paint from a window having a frame said guide to be used with a razor blade scraper or the like having a flat side edge, which guide comprises:

a first panel having a pair of opposed edges, one of said edges having a straight elongated blade that is placed against said window flush with a sash or glazing of said window, said first panel positioned substantially vertical to said window so that said first panel provides guiding support for said flat side edge of said scraper;

a second panel extending from said opposed edge of said first panel, said second panel being in angular relation to said first panel;

a third panel extending from said second panel, said third panel being substantially parallel with said first panel wherein said scraper is then moved across said window along said elongated blade;

a fourth panel extending from said third panel wherein said fourth panel is substantially parallel with said second panel and is held in one hand of a user while the other hand moves said scraper, to remove excess dry paint on said window except for a thin band covered by said blade, each said panel being free of protrusions in order to be closely placed against said frame or a wall surrounding said window; and said panels forming means to hold the guide so that said first panel and said window form a space in which said scraper is manipulated with said side edge in full contact with said first panel without any part of said second, third or fourth panels or said user's guide-holding hand intruding into said space.

2. A guide for removing excess dry paint from a window set forth in claim 1 wherein the width of said elongated blade is adjustable by addition of tape to vary the thickness of the band of said paint which will remain on said window.

3. A guide for removing excess dry paint from a window as set forth in claim 1 wherein said second panel is a bearing plate so that pressure may be applied against said second panel to prevent said thin band of paint on said window from shattering.

4. A guide for removing excess dry paint from a window as set forth in claim 1 wherein said panels are fabricated from a single piece of material.

5. A guide for removing excess dry paint from a window as set forth in claim 4 wherein said panels are fabricated from stainless.

* * * * *